US008994296B1

(12) United States Patent
Chan

(10) Patent No.: US 8,994,296 B1
(45) Date of Patent: Mar. 31, 2015

(54) EXTERNAL CONTROL MODULE FOR AN LED DRIVER

(75) Inventor: Chun Wah Chan, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 210 days.

(21) Appl. No.: 13/599,104

(22) Filed: Aug. 30, 2012

Related U.S. Application Data

(60) Provisional application No. 61/528,802, filed on Aug. 30, 2011.

(51) Int. Cl.
*H05B 39/06* (2006.01)

(52) U.S. Cl.
USPC ..... 315/362; 250/459.1; 315/112; 315/32

(58) Field of Classification Search
USPC ..... 315/362, 32, 112; 250/459.1
See application file for complete search history.

(56) References Cited

U.S. PATENT DOCUMENTS 4,579,407 A * 4/1986 Shimada ..... 439/502
6,909,834 B2 * 6/2005 Tomino et al. ..... 385/135
8,222,820 B2 * 7/2012 Wang et al. ..... 315/32
2004/0047581 A1 * 3/2004 Tomino et al. ..... 385/135
2005/0128751 A1 * 6/2005 Roberge et al. ..... 362/276
2009/0026979 A1 * 1/2009 Reid ..... 315/297
2010/0264752 A1 * 10/2010 Wong et al. ..... 307/116
2011/0037387 A1 * 2/2011 Chou et al. ..... 315/35
2011/0116203 A1 * 5/2011 Chan et al. ..... 361/220
2011/0207140 A1 * 8/2011 Handique et al. ..... 435/6.12
2012/0145924 A1 * 6/2012 Tinsley ..... 250/459.1

* cited by examiner

*Primary Examiner* — Douglas W Owens
*Assistant Examiner* — Syed M Kaiser
(74) *Attorney, Agent, or Firm* — King & Spalding LLP

(57) ABSTRACT

In general, the disclosure relates to setting current output of an LED driver. In one embodiment, an external control module for setting a current output of an LED driver includes a plurality of voltage referenced elements. The external module also includes a plurality of switches. Each switch of the plurality of switches is coupled to a corresponding voltage referenced element of the plurality of voltage referenced elements. The external control module further includes an enclosure covering the plurality of switches, wherein the enclosure substantially prevents adjustment of switch positions of the plurality of switches. The external control module can be adjusted to set the desired output current prior to enclosing the external control module in the enclosure in connection with the assembly of a light fixture.

18 Claims, 6 Drawing Sheets

EXTERNAL CONTROL MODULE FOR AN LED DRIVER

RELATED APPLICATIONS

The present application claims priority to U.S. Provisional Patent Application Ser. No. 61/528,802, filed Aug. 30, 2011, and titled "External Control Module For An LED Driver," the entire contents of which is incorporated herein by reference.

TECHNICAL FIELD

The present disclosure relates generally to light fixtures, and more particularly to systems, methods, and apparatuses for driving current for LED light fixtures.

BACKGROUND

For many years, fluorescent light fixtures have dominated markets for lighting applications. Recently, advances in light emitting diode ("LED") technology have allowed LED light fixtures to compete with linear fluorescent products on light output, uniformity, and efficacy. As a wide variety of LED light fixtures have become available, different LED drivers are needed to provide a constant current output to the different LED light fixtures.

Typically, different LED fixtures require different lumen levels. Different lumen levels are achieved by applying different drive current output levels. Presently, LED drivers produce constant current outputs. LED drivers do not have the capability to adjust or change the current level of the constant current output above a particular current limit. One reason for this is that safety regulations require that LED drivers have no capacity or capability for an end user to adjust current levels beyond certain limits. If the current output of an LED driver could be increased by an end user without a set limit, the LED driver could overheat an LED light fixture, which, for example, could cause fire. Thus, the LED driver must be configured to have at least either a constant current output or a limit to the maximum current output of the LED driver (e.g., for LED drivers with dimming capability) when it leaves the custody of the manufacturer. To this end, LED light fixture manufacturers typically inventory or stock a broad spectrum of constant current output LED drivers. When LED light fixtures are manufactured, LED drivers are matched with LED light fixtures according to the proper constant current output requirements for the LED light fixtures. No matter what the constant current output requirements may be for LED light fixtures, the manufacturers have at least one LED driver that provides the constant current output required. This approach may require manufacturers to inventory or stock many different LED drivers.

Currently, direct current settable/configurable electronic drivers for power LED and LED modules are known, which have multi-voltage and multi-current functionality. The multi-power driver is supplied with a dip-switch for selection of the current output. The dip-switch is incorporated into the LED driver so that anyone may adjust the current output, including the end user. For example, TCI Professional Light Applications markets a MAXI JOLLY driver. Such multi-voltage and multi-current LED drivers do not qualify for UL certification in the United States because end users could unwittingly increase the current output to such a level that the LED driver could over heat a LED light fixtures, which could cause fire.

Further, in the context of fluorescent light fixtures, U.S. Pat. No. 7,880,405 discloses an electronic ballast that is operable to receive a ballast factor setting that enables the ballast to provide a desired ballast factor when the ballast drives a fluorescent lamp. The method comprises the steps of: (1) receiving a request for the ballast adaptable to be configured with the desired ballast factor; (2) providing the ballast; and (3) configuring the ballast to have the desired ballast factor. The desired ballast factor is substantially prevented from subsequently being adjusted.

What is needed is a current output programmable LED driver, such that once a current output is set by a manufacturer, the current output cannot further be adjusted by an end user.

SUMMARY

In general, the disclosure relates to setting current output of an LED driver. In an exemplary embodiment, an external control module for setting a current output of an LED driver includes a plurality of voltage referenced elements. The external module also includes a plurality of switches. Each switch of the plurality of switches is coupled to a corresponding voltage referenced element of the plurality of voltage referenced elements. The external control module further includes an enclosure covering the plurality of switches, wherein the enclosure substantially prevents adjustment of switch positions of the plurality of switches.

In another exemplary embodiment, a process for manufacturing LED light fixtures includes identifying a current requirement of an LED light fixture. The process includes identifying an LED driver and connecting an external control module to the identified LED driver. The process also includes using the external control module to set the current output of the LED driver to substantially match the current requirement of the LED light fixture. The process further includes assembling the LED driver with the LED light fixture.

In yet another exemplary embodiment, a process for manufacturing an external control module for setting a current output of a light emitting diode (LED) driver includes identifying a current requirement of a light fixture. The process also includes identifying an LED driver and connecting an external control module to the identified LED driver. The process further includes adjusting a setting of the external control module to correspond to the current output of the LED driver that substantially matches the current requirement of the LED light fixture. The process also includes enclosing the external control module to substantially limit adjustment of the setting of the external control module.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
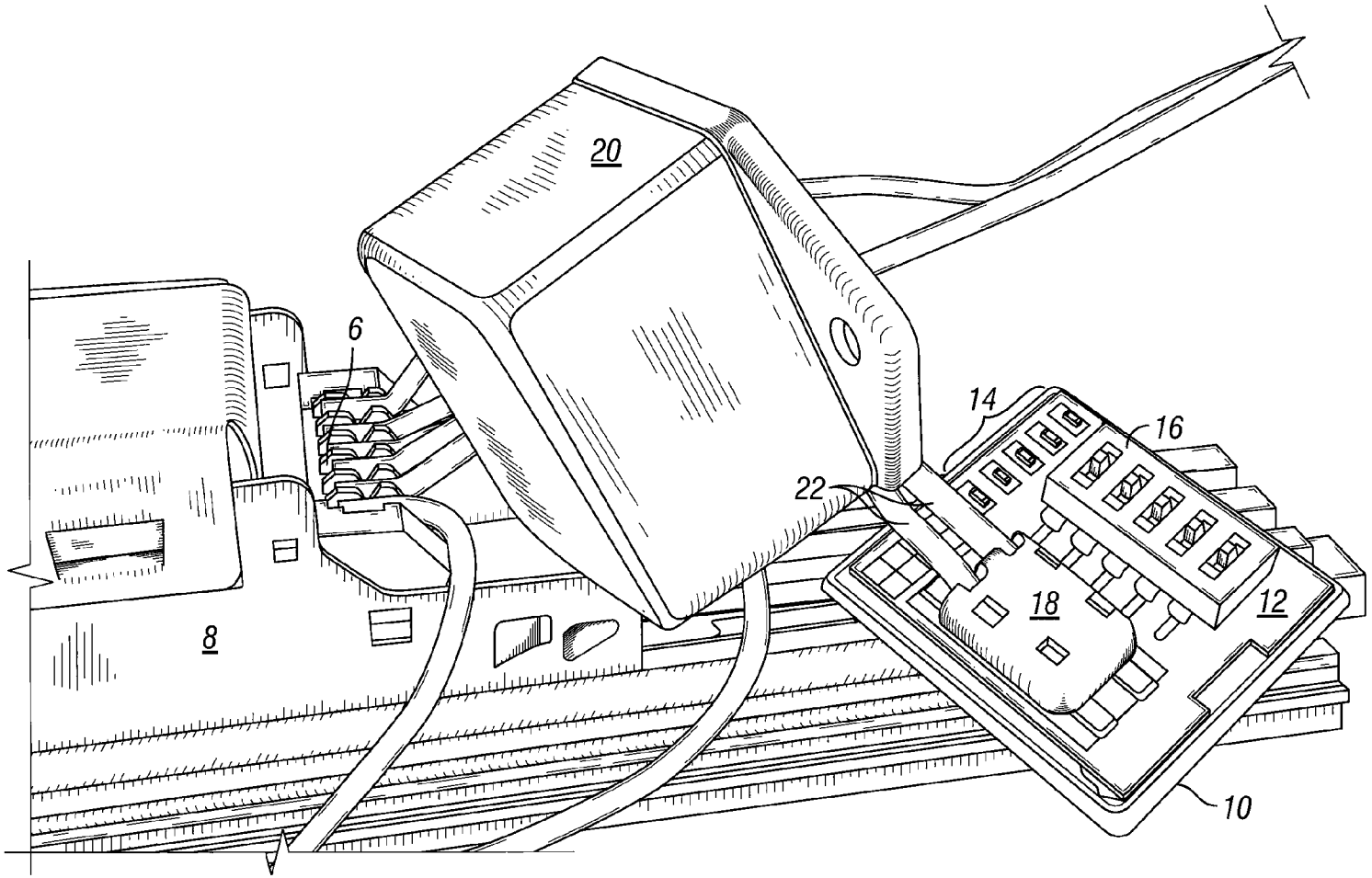
FIG. 1 shows exemplary system including an external control module connected to an LED driver included in an LED light fixture.

The drawings illustrate only exemplary embodiments of the invention and are therefore not to be considered limiting of its scope, as there may be other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF THE EXEMPLARY EMBODIMENTS

Embodiments of the disclosure are directed to systems, methods, and apparatuses for controlling current outputs of LED drivers. Embodiments now will be described more fully hereinafter with reference to the accompanying drawings, in which exemplary embodiments are shown. This disclosure may, however, be embodied in many different forms and should not be construed as limited to the embodiments set forth herein; rather, these embodiments are provided so that this disclosure will be thorough and complete, and will fully convey the scope of the invention to those skilled in the art.

In an exemplary embodiment, an external control module may be connected to an LED driver, while an LED light fixture is being assembled at a manufacturing facility. At least one dip switch of the external control module may be used to select individual resistors, which in turn control the current output of the LED driver. In the place of the dip switch, any switch or switches, such as a rotary switch or a potentiometer may be used as known to persons of skill in the art. Once the current output of the LED driver has been set by the external control module, the external control module may remain connected to the driver. The LED driver, with the current output set, and the external control module may be installed while manufacturing the LED light fixture.

Because LED drivers may be configured or set to produce a variety of current outputs, fewer LED drivers may need to be maintained in inventory. Through the use of an external control module, the output current may be adjusted down to any desired level between 0% and 100% of the maximum output current. In some embodiments, the output current may be adjusted down to about 50% of the maximum output current of an LED driver depending on Power Factor or total harmonic distortion (THD) requirements. For example, an LED driver that produces a maximum current output of 2100 milliamperes (mAmps) may be configured or set to produce a current output between 1365 mAmps and 2100 mAmps. As another example, an LED driver that produces a maximum current output of 1400 mAmps may be configured or set to produce a current output between 910 mAmps and 1400 mAmps. As still a further example, an LED driver that produces a maximum current output of 1000 mAmps may be configured or set to produce a current output between 650 mAmps and 1000 mAmps. By way of these exemplary LED drivers, a manufacturer could use only three LED drivers to provide any current outputs within the range of 650 mAmps to 2100 mAmps.

According to alternative embodiments, an external control module may be used to monitor the current and communicate to the driver for end of life situations. Other controls may be incorporated into this device such as day light harvesting, wireless dimming, emergency lighting, etc.

Referring to FIG. 1, an LED driver 6 and an external control module 10 are shown connected to an LED light fixture 8. At a manufacturing facility, before the light fixture goes to customers, the external control module 10 may be connected to the LED driver 6 to set a current output for the LED driver 6, depending on the current requirement of the LED light fixture 8.

The external control module 10 includes a circuit board 12, a plurality of switches 16 (shown in FIG. 1 as a DIP switch), a plurality of resistors 14, and a connector 18. The external control module 10 may also include an enclosure 20. The enclosure 20 is detached from the rest of the external control module 10 in FIG. 1. When the enclosure 20 is placed over the circuit board 12 covering the plurality of switches 16, the enclosure 20 substantially prevents adjustment of the switch positions of the plurality of switches 16. Wires 22 are attached to the connector 18 and provide a connection between the external control module 10 and the LED driver 6.

Figure 2:
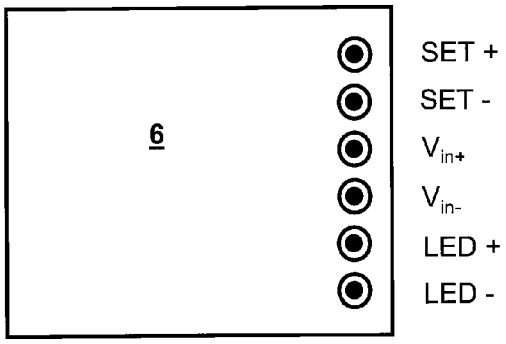
FIG. 2 illustrates an exemplary top view pinout of an LED driver.

Referring to FIG. 2, an exemplary pinout of the LED driver 6 is illustrated. The LED driver 6 may have the following pins: SET +, SET −, $V_{in+}$, $V_{in-}$, LED +, and LED −. A power supply (a wall outlet) may be connected to the $V_{in+}$ and $V_{in-}$ pins. The external control module 10, shown in FIG. 1, may be connected to the SET + and SET − pins to set a current output on the LED + and LED − pins of the LED driver 6. For example, one of the wires 22 shown in FIG. 1 may be connected to the SET + pin and the other one of the wires 22 may be connected to the SET − pin of the LED driver 6. The LED driver 6 may provide a current output to a light fixture, such as the LED light fixture 8 of FIG. 1, via the LED + and LED − pins.

Figure 3:
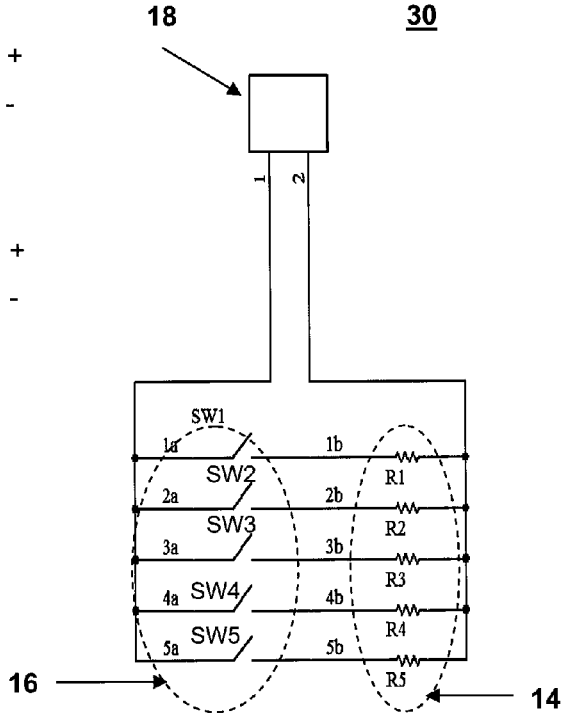
FIG. 3 shows an exemplary circuit diagram of an external control module.

Referring to FIG. 3, a circuit diagram 30 of an external control module 10 is illustrated. In an exemplary embodiment, the external control module 10 is electrically coupled to an LED driver (not shown), such as the LED driver 6 of FIG. 2, via circuit leads 1 and 2 and via the connector 18. The circuit leads 1 and 2 of the external control module 10 are electrically coupled to the SET + and SET − pins of the LED driver 6, respectively. For example, the circuit leads 1 and 2 of the external control module 10 may be electrically coupled to the SET + and SET − pins of the LED driver 6 via the connector 18. The external control module 10 includes the plurality of resistors 14 and the plurality of switches 16. The plurality of resistors 14 includes five resistors R1 through R5. In an exemplary embodiment, the two or more of the five resistors R1 through R5 may be connected in parallel.

The plurality of switches 16 includes five switches SW1 through SW5. Each of the five switches SW1 through SW5 may be independently set to a closed switch position (i.e., closed) or to an open switch position (i.e., open). Each of the five switches SW1 through SW5 is coupled to a corresponding resistor of the five resistors R1 through R5. Switch SW1 is coupled to resistor R1, switch SW2 is coupled to resistor R2, switch SW3 is coupled to resistor R3, switch SW4 is coupled to resistor R4, and switch SW5 is coupled to resistor R5.

In an exemplary embodiment, one or more of the switches SW1 through SW5 may be in a closed switch position (i.e., closed). By closing a particular switch of the five switches SW1 through SW5, a corresponding resistor of the five resistors R1 through R5 that is coupled in series with the closed switch becomes electrically coupled to the circuit leads 1 and 2. Accordingly, current may flow between the circuit leads 1 and 2 through a closed switch (e.g., SW1 set to have a closed switch position) and a resistor (e.g., R1) that is coupled in series with the particular closed switch. Two or more of the five resistors R1 through R5 become connected in a parallel configuration when corresponding two or more of the five switches SW1 through SW5 are in a closed switch position. A parallel configuration of two or more of the five resistors R1 through R5 results in a total (equivalent) resistance between the circuit leads 1 and 2 that is based on the parallel configuration of the two or more resistors.

In an exemplary embodiment, resistor R1 is a 0 ohm resistor, resistor R2 is a 133 ohm resistor, resistor R3 is a 340 ohm resistor, resistor R4 is a 510 ohm resistor, and resistor R5 is an 1150 ohm resistor. In this exemplary embodiment, when switch SW1 is closed (i.e., in a closed switch position) and all other switches are open (i.e., in open switch positions), only resistor R1 out of the five resistors R1 through R5 is electrically coupled between the circuit leads 1 and 2. When only resistor R1 of the five resistors R1 through R5 is coupled between the circuit leads 1 and 2, the external control module produces a current output of approximately 1.00 Amp that may be provided to a light fixture. When switch SW2 is closed and all other switches are open, only resistor R2 out of the five switches R1 through R5 is electrically coupled between the circuit leads 1 and 2. When only resistor R2 out of the five resistors R1 through R5 is coupled between the circuit leads 1 and 2, the external control module 10 produces a current output of approximately 1.20 Amp that may be provided to the light fixture. When switch SW3 is closed and all other switches are open, only resistor R3 out of the five switches R1 through R5 is electrically coupled between the circuit leads 1 and 2. When only resistor R3 out of the five resistors R1 through R5 is coupled between the circuit leads 1 and 2, the external control module 10 produces a current output of approximately 1.40 Amp that may be provided to the light fixture. When switch SW4 is closed and all other switches are open, only resistor R4 out of the five switches R1 through R5 is electrically coupled between the circuit leads 1 and 2. When only resistor R4 out of the five resistors R1 through R5 is coupled between the circuit leads 1 and 2, the external control module 10 produces a current output of approximately 1.50 Amp that may be provided to the light fixture. When switch SW5 is closed and all other switches are open, only resistor R5 out of the five switches R1 through R5 is electrically coupled between the circuit leads 1 and 2. When only resistor R5 out of the five resistors R1 through R5 is coupled between the circuit leads 1 and 2, the external control module 10 produces a current output of approximately 1.70 Amp that may be provided to the light fixture.

When two or more resistors of the five resistors R1 through R5 are coupled in parallel between the circuit leads 1 and 2 by closing two or more of the five switches SW1 through SW5, the external control module may produce other current output amounts corresponding to the equivalent resistance of the two or more resistors that are coupled in parallel between the circuit leads 1 and 2. For example, resistors R2 and R3 may be connected in parallel between the circuit leads 1 and 2 by closing switches SW2 and SW3. As another example, resistors R2 and R4 may be connected in parallel between the circuit leads 1 and 2 by closing switches SW2 and SW4. In yet another example, resistors R2, R3, and R5 may be connected in parallel between the circuit leads 1 and 2 by closing switches SW2, SW3, and SW5. The current output produced by the external control module 10 corresponds to the equivalent resistance of the two or more resistors that are electrically coupled between the circuit leads 1 and 2. Using different combinations of closed and open switches, various permutations of parallel configurations of the plurality of resistors 14 may be achieved to expand flexibility of the external control module 10 to produce a desired current output.

Although FIG. 3 shows five resistors R2 through R5, in alternative embodiments, the plurality of resistors 14 may include more than five resistors or fewer than five resistors. Additionally, the resistance values and current output values described with respect to FIG. 3 are exemplary, and, in other embodiments, the resistance values may correspond to different current outputs of an LED driver. Further, although FIG. 3 shows that the external control module 10 includes the plurality of resistors 14, in alternative embodiments, the external control module 10 may include other resistive elements instead of resistors. In addition, each resistor R1 through R5, although shown as a single resistor, may include more than one resistor. Further, other voltage referenced elements (e.g., Zener diodes) may be used instead of the plurality of resistors 14. For example, Zener diodes may be coupled between the circuit leads 1 and 2 in a substantially similar configuration as the plurality of resistors 14.

Figure 4A:
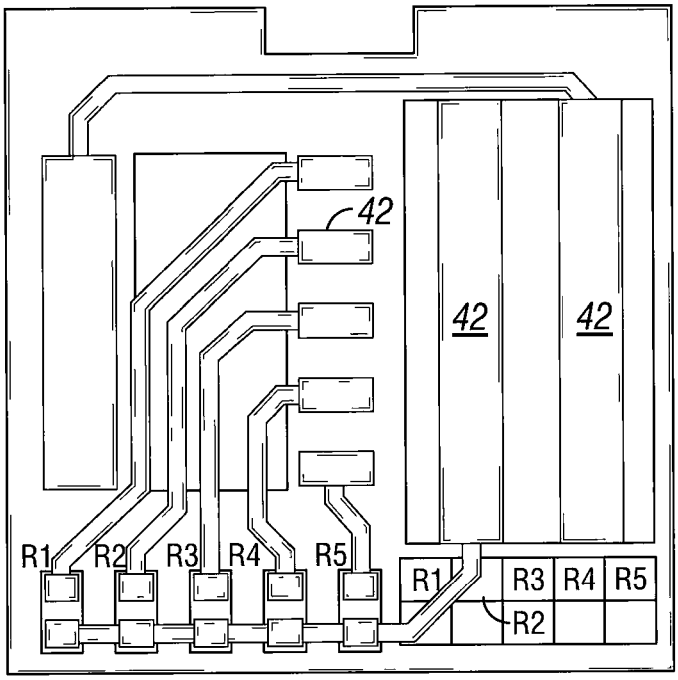
FIG. 4A is a top view of an exemplary printed circuit board of an external control module prior to being populated with components.

Referring to FIG. 4A, a top view of a printed circuit board 12 of the external control module 10 is shown. In FIG. 4A, the printed circuit board 12 is shown prior to populating the printed circuit board 12 with components, such as resistors and switches. The printed circuit board 12 includes traces 42 electrically coupling the five resistors R1 through R5, the five switches SW1 through SW5, and the connector 18 as described with respect to FIG. 3.

Figure 4B:
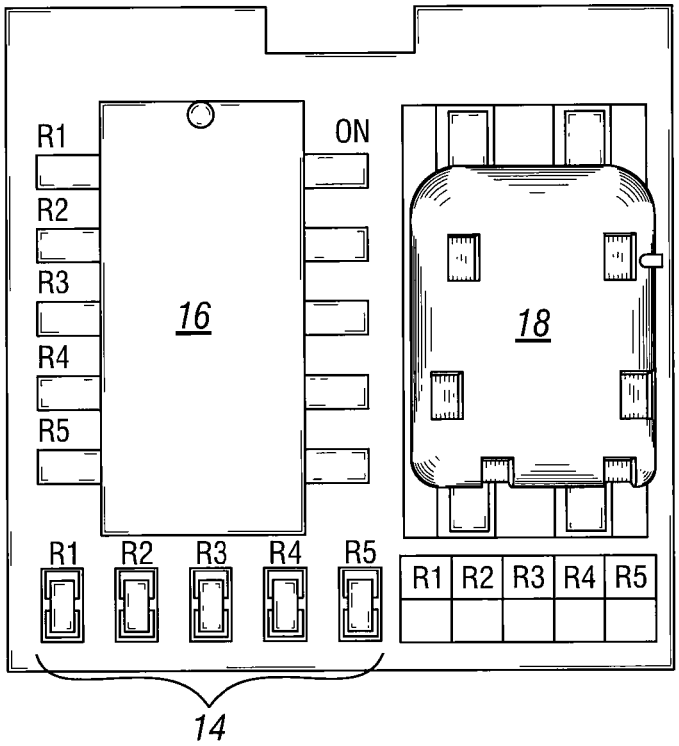
FIG. 4B illustrates a top view of the exemplary printed circuit board of FIG. 4A after being populated with components.

FIG. 4B illustrates a top view of the printed circuit board 12 of FIG. 4A after the printed circuit board 12 is populated with components. The plurality of switches 16 (e.g., a DIP switch) including the five switches SW1 through SW5 is attached to the printed circuit board. The plurality of resistors 14 including the five resistors R1 through R5 is also attached to the printed circuit board 12. Further, the connector 18 is attached as shown.

Figure 5:
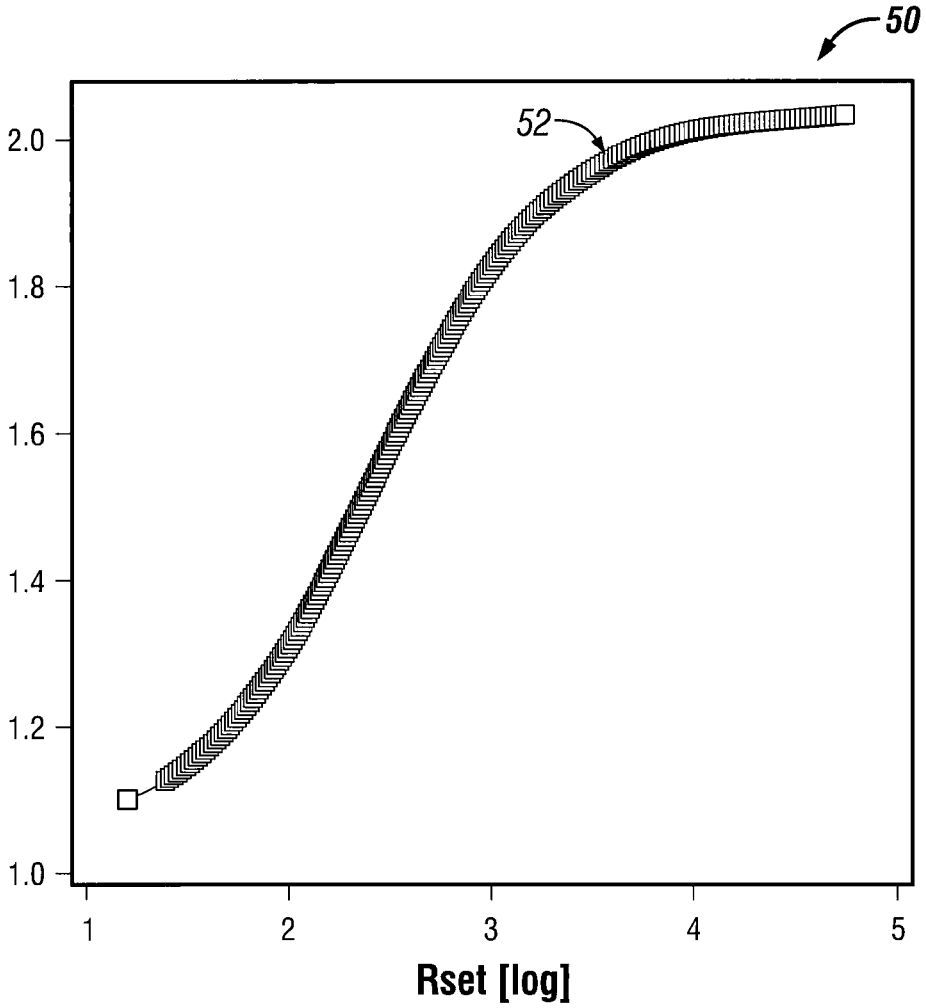
FIG. 5 illustrates an exemplary graph of a base 10 logarithm [log] of an equivalent resistance (Rset) of one of more resistors in an external control module plotted against current output (in amperes) of an LED driver.

FIG. 5 illustrates an exemplary graph 50 of a current output (in amperes) and base 10 logarithm, [log], of an equivalent resistance (Rset). The curve 52 is an exemplary illustration of the relationship between the base 10 logarithm, [log], of the equivalent resistance (Rset) of one or more resistors of the plurality of resistors 14 of FIGS. 1, 3, and 4B and the current output of the LED driver 6. The x-axis is the base 10 logarithm [log] of the equivalent resistance (Rset) of one or more resistors that are coupled to a corresponding closed switch of the plurality of switches 16. For example, Rset may correspond to an equivalent resistance of one or more of the five resistors R1 through R5 of FIG. 3 that are coupled to a corresponding switch SW1 through SW5 that is in a closed switch position. To illustrate, if switches SW2 and SW3 of FIG. 3 are closed, the equivalent resistance Rset is determined based on resistances of resistors R2 and R3 that are in a parallel configuration.

The y-axis represents a current output (in amperes) of the LED driver 6 of FIGS. 1 and 2. For example, if the LED driver 6 has a maximum current output of 2 Amps, one or more resistors of the plurality of resistors 14 may be configured to set the output current of the LED driver 6 within the range of 1.2 Amps through 2.0 Amps.

Typical LED drivers experience a total harmonic distortion (THD) as high as 20% when the output current is set at 65% or lower of the maximum output current. For most LED drivers, it is possible to control the current output between 65% through 100% of the maximum current output of the LED driver without the THD falling outside an acceptable range. Some LED drivers may also operate within acceptable TDH range even when the current output of the LED drivers is outside of the 65% to 100% of the maximum output current. For example, in an exemplary embodiment, the LED driver 6 may operate within acceptable TDH range when generating current output that is approximately 50% to 100% of the maximum output current of the LED driver 6.

Figure 6A:
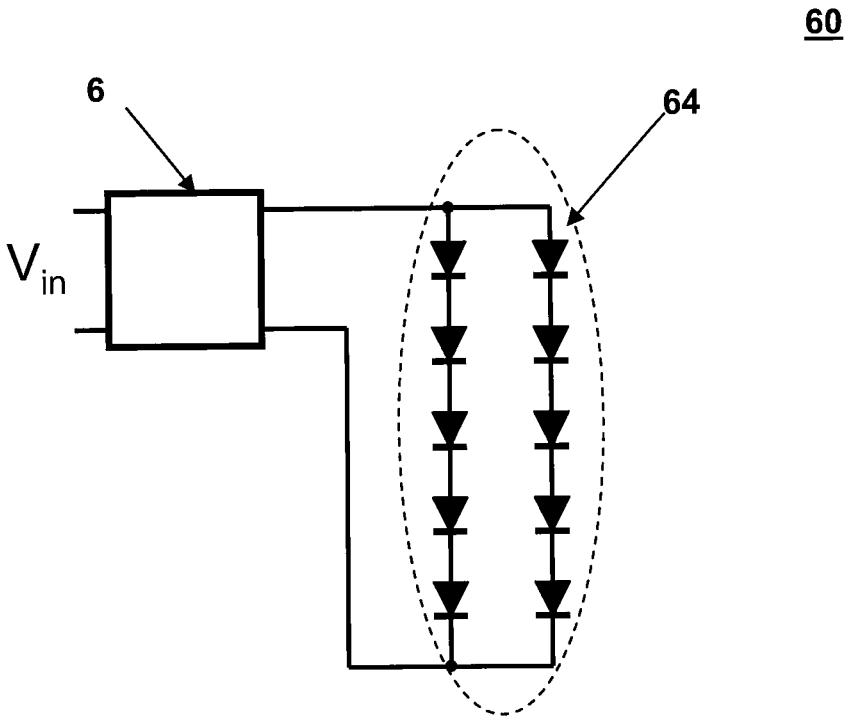
FIG. 6A is an exemplary schematic diagram of an LED light fixture having ten LEDs that are driven by an LED driver.
Figure 6B:
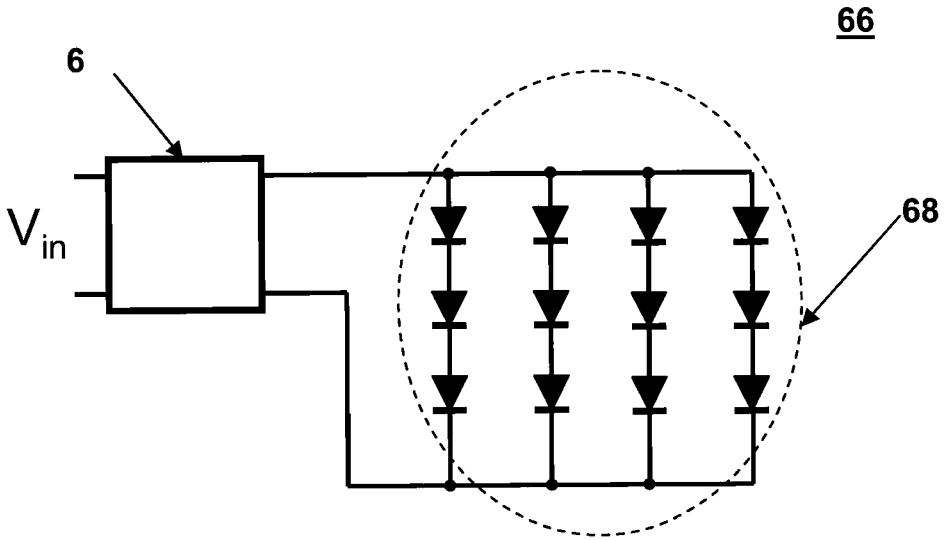
FIG. 6B is an exemplary schematic diagram of an LED light fixture having twelve LEDs that are driven by an LED driver.

Referring to FIG. 6A, an exemplary system 60 including an LED driver 6 and an LED light fixture 64 including ten LEDs is illustrated. The LED light fixture 64 including the ten LEDs is driven by an LED driver 6. For example, the LED light fixture 64 may be a high powered LED light fixture. The LED driver 6 is coupled to a power supply via the Vin pins. FIG. 6B illustrates an exemplary system 66 including an LED driver 6 and an LED light fixture 68 having twelve LEDs. For example, the LED light fixture 68 may be a high powered LED light fixture. The LED light fixture 68 including the twelve LEDs is driven by an LED driver 6. As an example, the LED light fixture 64 of FIG. 6A could have a power requirement of 1600 mAmp while the LED light fixture 68 of FIG. 6B could have a power requirement of 2000 mAmp. When these LED light fixtures 64, 68 of FIGS. 6A and 6B are manufactured, identical LED drivers, each having a maximum current output of 2100 mAmp, may be set for each light fixture 64, 68. For example, the LED driver 6 may have a maximum current output of 2100 mAmp and may be set to 1600 mAmp for the LED light fixture 64 of FIG. 6A and may be set to 2000 mAmp for the LED light fixture 68 of FIG. 6B. Accordingly, a manufacture may stock or inventory a single type of 2100 mAmp LED drivers for use with both LED light fixture 64 and 68 of FIGS. 6A and 6B, respectively.

Figure 7:
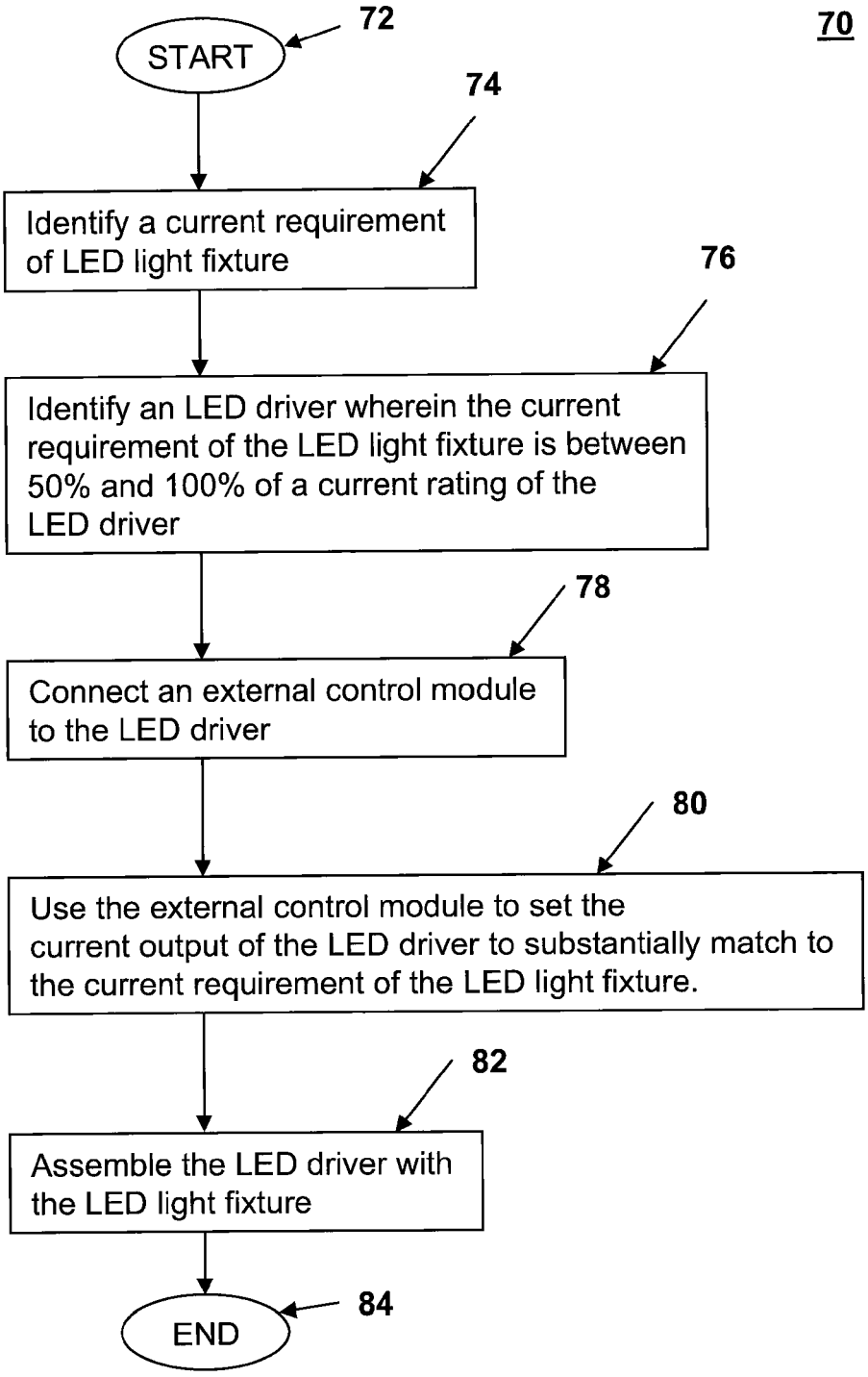
FIG. 7 is a flow chart of a process for manufacturing LED light fixtures.

FIG. 7 is a flow chart of a process 70 for manufacturing LED light fixtures. Following a start of the process at 72, the process 70 includes identifying a current requirement of a light fixture, at 74. For example, a current requirement of an LED light fixture, such as the LED light fixture 8 of FIG. 1, the LED light fixture 64 of FIG. 6A and the LED light fixture 68 of FIG. 6B may be identified. The process 70 further includes identifying an LED driver, at 76. The current requirement of the LED light fixture may be between approximately 50% and approximately 100% of the current rating (i.e., the maximum current output) of the LED driver. For example, if the current requirement of the light fixture is 1800 mAmp, an LED driver that has a current rating of 2100 mAmp may be identifier.

An external control module is connected to the identified LED driver, at 78. For example, the external control module 10 of FIG. 1 may be connected to the LED driver 6 of FIGS. 1 and 2. The external control module is used to set the current output of the LED driver to substantially match the current requirement of the LED light fixture, at 80. A setting of the external control module may be adjusted to correspond to a current output of the LED driver that substantially matches the current requirement of the LED light fixture. For example, by setting the switch position of each switch of the plurality of switches 16 of FIGS. 1, and 3 to an open or closed switch position, the current output of the LED driver 6 of FIGS. 1 and 2 may be set to substantially match the current requirement of an LED light fixture. As described with respect to FIG. 3, the current output of the LED driver 6 of FIGS. 1 and 2 may correspond to the equivalent resistance of one or more resistors of the plurality of resistors 14 that have a corresponding switch in a closed switch position. The LED driver is assembled with the LED light fixture, at 82. The LED light fixture is then ready for distribution to end users. The process 70 ends at 84.

In an exemplary embodiment, the process 70 may also include enclosing (not shown) the external control module to substantially limit adjustment of the setting of the external control module. For example, the external control module 10 may include an enclosure, such as the enclosure 20 of FIG. 1, to substantially cover the plurality of switches 16 (e.g., a DIP switch in FIG. 1) once switch positions of the plurality of switches is set. Enclosing the external control module 10 may limit subsequent adjustability of the switch positions of the plurality of switches 16, for example, by consumers.

The invention may be applied to any LED driver for any light fixture application, including indoor and outdoor LED light fixtures. The LED drivers may also have any maximum output current ratings.

Another aspect of the invention is to include control features. One example of a control feature is adjustment over time of the current output of an LED driver by an external control module. For example, an LED driver having a maximum current output of 2 Amps may be initially set to generate 1.7 Amps. Over time, the external control module may adjust the LED driver to generate current output that is higher or lower than the 1.7 Amps. For example, the current output of the LED driver may be set to increase over time. In an exemplary embodiment, a microcontroller may be included in the external control module to provide control functionality. Alternatively, the external control module may have a microcontroller interface to allow adjustment of control settings to increase or decrease the current output of the LED driver without exceeding the maximum current output of the LED driver. In general, control functionality may be implemented using a microcontroller or a resistor set. Further, light or current sensors or time monitoring features may also be added. Thus, if the current requirements of the LED light fixtures change over time, the microcontroller of the external control module may adjust the current output in response to the changed current requirements.

Although the inventions are described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. An external control module for setting a current output of a light emitting diode (LED) driver, the external control module comprising:

a plurality of voltage referenced elements, wherein the plurality of voltage referenced elements includes a plurality of resistive elements, wherein the plurality of resistive elements is coupled to a first terminal of the LED driver;

a plurality of switches, wherein the plurality of switches is coupled to a second terminal of the LED driver and wherein each switch of the plurality of switches is coupled to a corresponding voltage referenced element of the plurality of voltage referenced elements; and an enclosure covering the plurality of switches, wherein the enclosure substantially prevents adjustment of switch positions of the plurality of switches.

2. The external control module of claim 1, wherein an output current of the LED driver is set based on a resistance of one or more resistive elements of the plurality of resistive elements, wherein the one or more resistive elements are electrically coupled to the first terminal of the LED driver and to the second terminal of the LED driver.

3. The external control module of claim 1, wherein a switch of the plurality of switches is set to a closed switch position to enable current to flow through the switch and a resistive element of the plurality of resistive elements that is coupled to the switch.

4. The external control module of claim 3, wherein the first terminal of the LED driver is electrically coupled to the second terminal of the LED driver through the switch and the resistive element.

5. The external control module of claim 3, wherein a second switch of the plurality of switches is set to an open switch position to substantially prevent current flow through the second switch and through a second resistive element of the plurality of resistive elements that is coupled to the second switch.

6. The external control module of claim 1, further comprising a circuit board, wherein the plurality of switches and the plurality of resistive elements are attached to the circuit board.

7. The external control module of claim 1, wherein the plurality of resistive elements is selected from resistors, thermistors, and photoresistors.

8. The external control module of claim 1, wherein a resistive element of the plurality of resistive elements has approximately zero ohms resistance.

9. The external control module of claim 1, further comprising a connector attached to the circuit board, wherein one or more wires are coupled between the connector and the LED driver.

10. A process for manufacturing a light emitting diode (LED) light fixture, the process comprising:

identifying a current requirement of an LED light fixture;

identifying an LED driver;

connecting an external control module to the identified LED driver;

using the external control module to set a current output of the LED driver to substantially match the current requirement of the LED light fixture; and assembling the LED driver within the LED light fixture, wherein the external control module comprises:

a plurality of voltage referenced elements, wherein the plurality of voltage referenced elements includes a plurality of resistive elements, wherein the plurality of resistive elements is coupled to a first terminal of the LED driver;

a plurality of switches, wherein the plurality of switches is coupled to a second terminal of the LED driver and wherein each switch of the plurality of switches is coupled to a corresponding voltage referenced element of the plurality of voltage referenced elements; and an enclosure covering the plurality of switches, wherein the enclosure substantially prevents adjustment of switch positions of the plurality of switches.

11. The process of claim 10, further comprising substantially enclosing the external control module, wherein substantially enclosing the external control module limits adjustment of the current output of the LED driver using the external control module.

12. The process of claim 11, further comprising assembling the enclosed external control module within the light fixture.

13. The process of claim 10, wherein the output current of the LED driver is set based on a resistance of one or more resistive elements of the plurality of resistive elements.

14. The process of claim 10, wherein using the external control module to set the current output of the LED driver includes changing a switch position of at least one switch of the plurality of switches.

15. The process of claim 14, wherein changing the switch position of the at least one switch includes changing the switch position of the at least one switch from an open position to a closed position.

16. The process of claim 15, wherein changing the switch position of the at least one switch from the open switch position to the closed switch position couples at least one resistor of the plurality of resistors to the LED driver.

17. A process for manufacturing an external control module for setting a current output of a light emitting diode (LED) driver, the process comprising:

identifying a current requirement of an LED light fixture;

identifying an LED driver;

connecting an external control module to the identified LED driver;

adjusting a setting of the external control module to correspond to a current output of the LED driver that substantially matches the current requirement of the LED light fixture; and enclosing the external control module to substantially limit adjustment of the setting of the external control module, wherein the external control module comprises:

a plurality of voltage referenced elements, wherein the plurality of voltage referenced elements includes a plurality of resistive elements, wherein the plurality of resistive elements is coupled to a first terminal of the LED driver;

a plurality of switches, wherein the plurality of switches is coupled to a second terminal of the LED driver and wherein each switch of the plurality of switches is coupled to a corresponding voltage referenced element of the plurality of voltage referenced elements; and an enclosure covering the plurality of switches, wherein the enclosure substantially prevents adjustment of switch positions of the plurality of switches.

18. The process of claim 17, further comprising assembling the LED driver with the LED light fixture.

* * * * *